US011532281B2

(12) United States Patent
Cherng et al.

(10) Patent No.: US 11,532,281 B2
(45) Date of Patent: Dec. 20, 2022

(54) ELECTRONIC DEVICE CAPABLE OF REDUCING PERIPHERAL CIRCUIT AREA

(71) Applicant: InnoLux Corporation, Miao-Li County (TW)

(72) Inventors: Yi-Shiuan Cherng, Miao-Li County (TW); Chia-Hao Tsai, Miao-Li County (TW); Chang-Chiang Cheng, Miao-Li County (TW); Yung-Hsun Wu, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 0 days.

(21) Appl. No.: 17/334,813

(22) Filed: May 31, 2021

(65) Prior Publication Data

US 2021/0287615 A1 Sep. 16, 2021

Related U.S. Application Data

(62) Division of application No. 16/664,966, filed on Oct. 28, 2019, now Pat. No. 11,056,064.

(60) Provisional application No. 62/794,562, filed on Jan. 19, 2019, provisional application No. 62/767,517, filed on Nov. 15, 2018.

(30) Foreign Application Priority Data

Jul. 22, 2019 (CN) ..... 201910662899.6

(51) Int. Cl.
*G09G 3/3291* (2016.01)
*G09G 3/36* (2006.01)

(52) U.S. Cl.
CPC ..... *G09G 3/3291* (2013.01); *G09G 3/3688* (2013.01); *G09G 2310/0286* (2013.01); *G09G 2310/0297* (2013.01)

(58) Field of Classification Search
None
See application file for complete search history.

(56) References Cited

U.S. PATENT DOCUMENTS

2003/0174115 A1* 9/2003 Washio ..... G09G 3/3688 345/98

* cited by examiner

*Primary Examiner* — Nicholas J Lee
(74) *Attorney, Agent, or Firm* — Winston Hsu

(57) ABSTRACT

A display panel includes a first shift register, a first demultiplexer, a plurality of first gate lines, and a plurality of rows of first sub-pixels. The first shift register outputs a first shift signal. The first demultiplexer is coupled to the first shift register and receives the first shift signal and outputs a plurality of first gate driving signals. The plurality of first gate lines receive the plurality of first gate driving signals. Each row of first sub-pixels is coupled to a corresponding first gate line of the plurality of first gate lines. The first sub-pixels of the same row emit light of a same color.

6 Claims, 11 Drawing Sheets

ELECTRONIC DEVICE CAPABLE OF REDUCING PERIPHERAL CIRCUIT AREA

CROSS REFERENCE TO RELATED APPLICATIONS

This application is a divisional of U.S. patent application Ser. No. 16/664,966, filed Oct. 28, 2019, the entire content of which is incorporated herein by reference. This application further claims priority to U.S. provisional patent application Ser. No. 62/767,517, filed Nov. 15, 2018, U.S. provisional patent application Ser. No. 62/794,562, filed Jan. 19, 2019, and China patent application No. 201910662899.6, filed Jul. 22, 2019, the entire content of each of which is incorporated herein by reference.

BACKGROUND OF THE DISCLOSURE

1. Field of the Disclosure

The present disclosure is related to a display panel and an electronic device thereof, and more particularly to a display panel capable of reducing peripheral circuit area and an electronic device thereof.

2. Description of the Prior Art

With the development of smart phone technology and Internet applications, the functions of smart phones have become more and more powerful, and even changed people's life styles. For example, people are increasingly accustomed to using smartphones to browse the web, watch videos, and take photos. Since many multimedia applications are visually related, the demand for large screen size on smartphones also increases.

For today's consumer electronics products, full-screen mobile phones have become a market trend. In order to increase the proportion of the screen to the body, designers must find ways to reduce the circuits and wires around the screen to reduce the widths of the frame of the screen. In general, the bottom frame of the screen usually has to accommodate more circuits and wires, such as the fanout circuits, connection pads, and pixel data demultiplexers, than the left-side frame and right-side frame of the screen. Therefore, how to reduce the area required for the circuits and wires at the bottom frame of the screen becomes a common issue when the designer tries to reduce the widths of the bottom frame of the screen.

SUMMARY OF THE DISCLOSURE

One embodiment of the present disclosure discloses a display device. The display device includes a first shift register, a first demultiplexer, a plurality of first gate lines, and a plurality of rows of first sub-pixels.

The first shift register outputs a first shift signal. The first demultiplexer is coupled to the first shift register and receives the first shift signal and outputs a plurality of first gate driving signals. The plurality of first gate lines receive the plurality of first gate driving signals. Each row of first sub-pixels is coupled to a corresponding first gate line of the plurality of first gate lines. The first sub-pixels of the same row emit light of a same color.

Another embodiment of the present disclosure discloses a display device. The display device includes a gate driving circuit, a plurality of gate lines, and a plurality of rows of sub-pixels.

The gate driving circuit includes a plurality of shift registers for outputting a plurality of gate driving signals. The plurality of gate lines receive the plurality of gate driving signals. Each of the plurality of rows of sub-pixels is coupled to a corresponding gate line of the plurality of gate lines. The sub-pixels of a same row emit light of a same color.

Another embodiment of the present disclosure discloses an electronic device. The electronic device includes a first demultiplexer, a plurality of first gate lines, and a plurality of rows of first sub-pixels.

The first demultiplexer receives a first shift signal and outputs a plurality of first gate driving signals. The plurality of first gate lines are coupled to the first demultiplexer and receive the plurality of first gate driving signals. Each of the first sub-pixels is coupled to a corresponding first gate line of the plurality of first gate lines. The first sub-pixels corresponding to a same first gate line of the plurality of first gate lines emit light of a same color.

These and other objectives of the present disclosure will no doubt become obvious to those of ordinary skill in the art after reading the following detailed description of the embodiment that is illustrated in the various figures and drawings.

DETAILED DESCRIPTION

In the present disclosure, the electronic device can be, for example but not limited to, a display device, a light source device, a backlight device, a sensing device, an antenna device or a connection device. The electronic device can be flexible or bendable electronic device. The electronic device can, for example, include the liquid crystal or light emitting diodes (LEDs). The light emitting diodes can, for example but not limited to, include the arbitrary combination of organic light emitting diodes (OLEDs), inorganic light emitting diodes, mini-meter-sized LED, micro-meter-sized LED, quantum dot (such as QLED and QLED), fluorescence, phosphor, and any other proper material. Also, the electronic device can be the arbitrary combination the aforementioned items. The present disclosure will use the display panel and display device as examples of the electronic devices for explanation. However, this is not to limit the scope of the present disclosure. Furthermore, the electronic device can be applied to any other electronic products, for example but not limited to television, tablet, notebook, cell phone, camera, wearable devices, electronic entertainment devices, LCD antennas, etc.

Also, the features of several different embodiments may be substituted, recombined, and mixed to become other embodiments without departing from the spirit of the disclosure.

Figure 1:
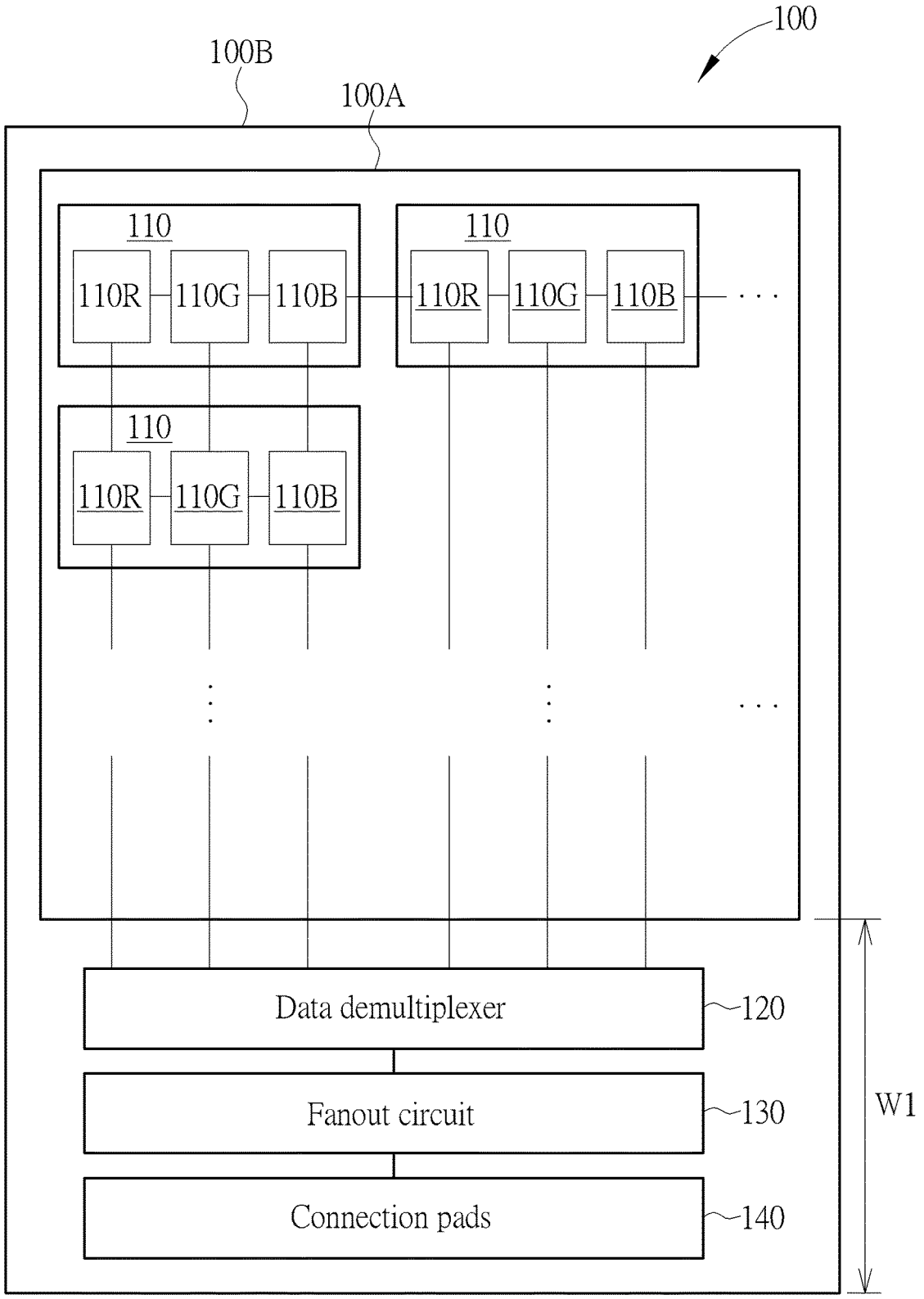
FIG. 1 shows an electronic device according to one embodiment of the present disclosure.

FIG. 1 shows an electronic device 100 according to one embodiment of the present disclosure. In the present embodiment, the electronic device 100 includes a display panel and a driving system. However, in some other embodiments, the electronic device 100 may not include the display panel. In FIG. 1, the electronic device 100 includes an active area 100A (the display area or the area presenting the main functions) and an inactive area 100B (accommodating the peripheral circuits) disposed adjacent to the edges of the active area 100A. In the present embodiment, a plurality of pixels 110 are disposed on the active area 100A, and each of the pixels 110 can include sub-pixels emitting light of different colors, for example, the red sub-pixel 110R, the green sub-pixel 110G, and the blue sub-pixel 110B. In some other embodiments, for example but not limited to, each of the pixels can include red sub-pixel, the green sub-pixel, the blue sub-pixel, and the white sub-pixel, or each of the pixels can include red sub-pixel, the green sub-pixel, the blue sub-pixel, and the yellow sub-pixel, for example but not limited to. In each pixel 110, the sub-pixels are arranged horizontally. That is, in each pixel 110, the pixel electrodes of the red sub-pixel 110R, the green sub-pixel 110G, and the blue sub-pixel 110B will be coupled to the same gate lines through switches so that the red sub-pixel 110R, the green sub-pixel 110G, and the blue sub-pixel 110B can receive the same gate driving signal and start the scan operation simultaneously. Also, by inputting different data voltages, the pixel 110 would be able to present different colors and different gray levels, and together with the other pixels 110 to form a color or monochrome image. Since the red sub-pixel 110R, the green sub-pixel 110G, and the blue sub-pixel 110B are disposed at the specific positions in the pixel 110, for example, the red sub-pixel 110R, the green sub-pixel 110G, and the blue sub-pixel 110B can be sequentially disposed from left to right in the pixel 110, the red sub-pixels of different pixels 110 would be arranged in a stripe along the column direction perpendicular to the gate lines (that is, in parallel with the data lines), and so as the green sub-pixels and the blue sub-pixels.

In FIG. 1, the data demultiplexer 120, the fanout circuit 130, and the connection pads 140 (for coupling to the integrated circuits) are disposed at the bottom of the inactive area 100B of the electronic device 100. In each pixel 110, since the red sub-pixel 110R, the green sub-pixel 110G, and the blue sub-pixel 110B are disposed in the same row and are coupled to the same gate lines, the red sub-pixel 110R, the green sub-pixel 110G, and the blue sub-pixel 110B will receive the same gate driving signal and start the scan operation simultaneously. Therefore, to have the sub-pixels of different colors receive the corresponding data voltages to present the corresponding light, the electronic device 100 can transmit the data voltages corresponding to sub-pixels of different colors through the data demultiplexer 120.

Since the fanout circuit 130 and the connection pads 140 are also disposed in the inactive area 100B of the electronic device 100, the bottom frame of the electronic device 100 will require more area so the width W1 of the frame may not be reduced. In some other embodiments, the electronic device 100 can arrange the sub-pixels along a vertical direction in each pixel, that is, the red sub-pixels 110R would be arranged in stripes along the row direction, (that is, the extension direction of the gate lines in perpendicular to the data lines), and so as the green sub-pixels 110G and the blue sub-pixels 110B. In this case, sub-pixels coupled to the same gate line will have the same color filter or will emit light of the same color, allowing each pixel to receive different gate driving signals. Therefore, the data demultiplexer used in prior art can be reduced, thereby reducing the width of the bottom frame.

Figure 2:
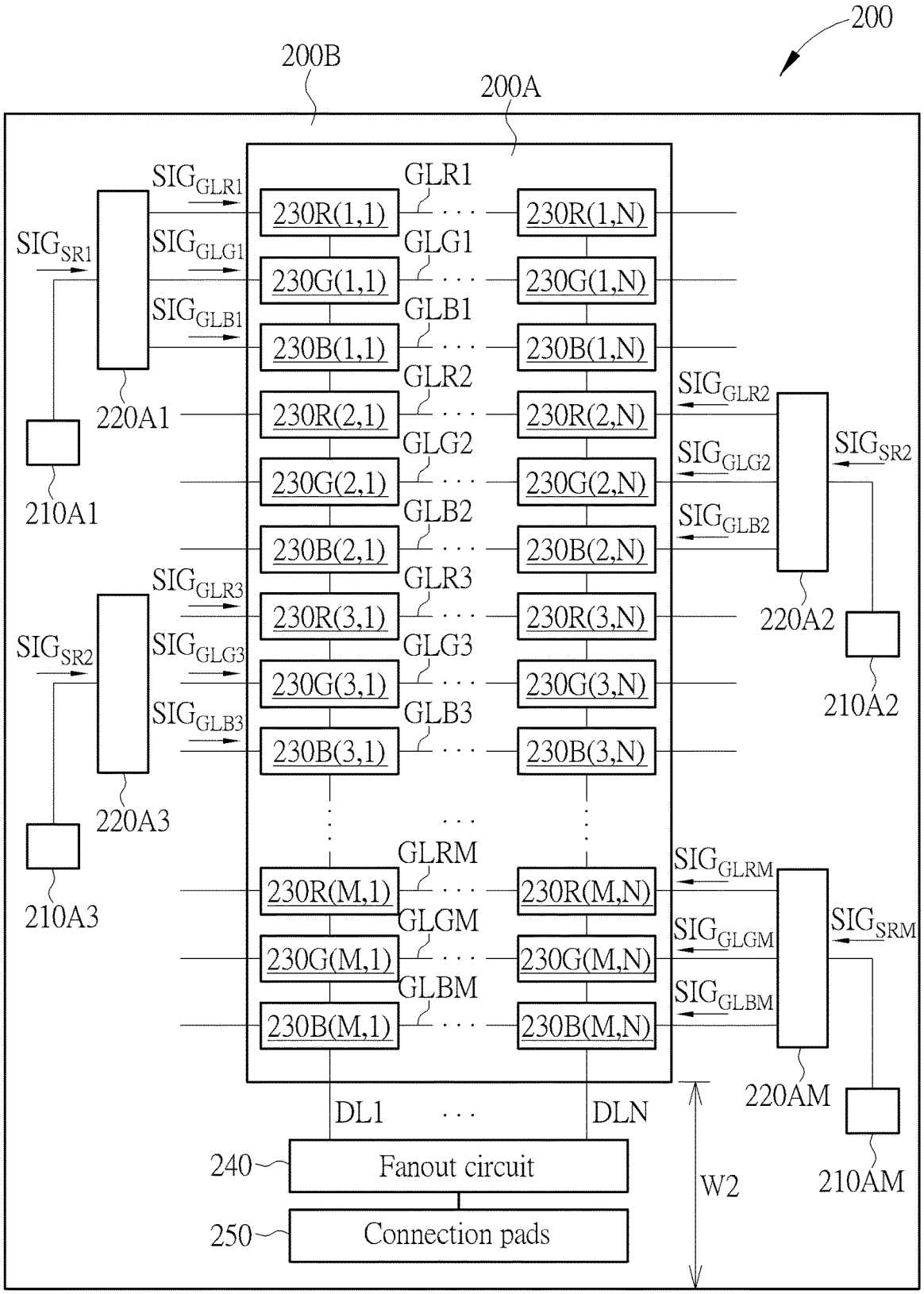
FIG. 2 shows an electronic device according to one embodiment of the present disclosure.

FIG. 2 shows an electronic device 200 according to one embodiment of the present disclosure. The electronic device 200 includes a first shift register 210A1, a first demultiplexer 220A1, a plurality of first gate lines GLR1, GLG1, and GLB1, and a plurality of rows of first sub-pixels 230R(1,1) to 230R(1,N), 230G(1,1) to 230G(1,N), 230B(1,1) to 230B(1,N), where N can be an integer greater than 1. In some other embodiments, the first gate lines GLR1, GLG1 and GLB1, and the plurality of rows of first sub-pixels 230R(1,1) to 230R(1,N), 230G(1,1) to 230G(1,N), 230B(1,1) to 230B(1,N) can be disposed in the active area 200A of the electronic device 200. Also, the first shift register 210A1 and the first demultiplexer 220A1 can be disposed in the inactive area 200B of the electronic device 200 at sides of the first sub-pixels 230R(1,1) to 230R(1,N), 230G(1,1) to 230G(1,N), 230B(1,1) to 230B(1,N).

In FIG. 2, the first sub-pixels 230R(1,1) to 230R(1,N) can emit the red light, the first sub-pixels 230G(1,1) to 230G(1,N) can emit the green light, and the first sub-pixels 230B(1,1) to 230B(1,N) can emit the blue light. However, in some other embodiments, the electronic device 200 may include sub-pixels emitting light of other different colors, for example white sub-pixels or yellow sub-pixels.

In addition, in FIG. 2, sub-pixels disposed in the same row can emit light of the same color while sub-pixels emitting light of different colors are arranged along the vertical direction, that is, along the column direction. For example, the first sub-pixels 230R(1,1), 230G(1,1), and 230B(1,1) can be disposed in the same column, and can be coupled to the same data line. Also, the first sub-pixels 230R(1,1) to 230R(1,N) can be disposed in the same row, and can be controlled by the same gate line. The first sub-pixels 230G(1,1) to 230G(1,N) can be disposed in the same row, and can be controlled by the same gate line, and the first sub-pixels 230B(1,1) to 230B(1,N) can be disposed in the same row, and can be controlled by the same gate line.

The first demultiplexer 220A1 can be coupled to the first shift register 210A1. The first shift register 210A1 can output the first shift signal SIGSR1, and the first demultiplexer 220A1 can receive the first shift signal SIGSR1 and output a plurality of first gate driving signals SIGGLR1, SIGGLG1, and SIGGLB1. The first gate lines GLR1, GLG1 and GLB1 can receive the first gate driving signals SIGGLR1, SIGGLG1, and SIGGLB1. Each row of first sub-pixels can be coupled to a corresponding first gate line of the first gate lines GLR1, GLG1, and GLB1. For example, the first sub-pixels 230R(1,1) to 230R(1,N) can be coupled to the first gate line GLR1, the first sub-pixels 230G(1,1) to 230G(1,N) can be coupled to the first gate line GLG1, and the first sub-pixels 230B(1,1) to 230B(1,N) can be coupled to the first gate line GLB1.

Similarly, in FIG. 2, the electronic device 200 can further include a second shift register 210A2, a second demultiplexer 220A2, a plurality of second gate lines GLR2, GLG2, and GLB2, and a plurality of rows of second sub-pixels 230R(2,1) to 230R(2,N), 230G(2,1) to 230G(2,N), and 230B(2,1) to 230B(2,N). The second demultiplexer 220A2 can be coupled to the second shift register 210A2. The second shift register 210A2 can output the second shift signal SIGSR2, and the second demultiplexer 220A2 can receive the second shift signal SIGSR2 and output a plurality of second gate driving signals SIGGLR2, SIGGLG2, and SIGGLB2 accordingly. The second gate lines GLR2, GLG2, and GLB2 can receive the second gate driving signals SIGGLR2, SIGGLG2, and SIGGLB2 respectively. The second sub-pixels 230R(2,1) to 230R(2,N) can be coupled to the second gate line GLR2, the second sub-pixels 230G(2,1) to 230G(2,N) can be coupled to the second gate line GLG2, and the second sub-pixels 230B(2,1) to 230B(2,N) can be coupled to the second gate line GLB2.

In addition, the electronic device 200 can further include data lines DL1 to DLN, and the data lines DL1 and DLN can be perpendicular to the gate lines GLR1, GLG1, GLB1, GLR2, GLG2, and GLB2. In another embodiment, the data lines may intersect the gate lines respectively. Each of the sub-pixels can be coupled to a corresponding data line of the data lines DL1 and DLN, receive the data voltage from the corresponding data line during the scan operation, and emit light with the gray level corresponding to the received data voltage during the emission operation to present the image.

Figure 3:
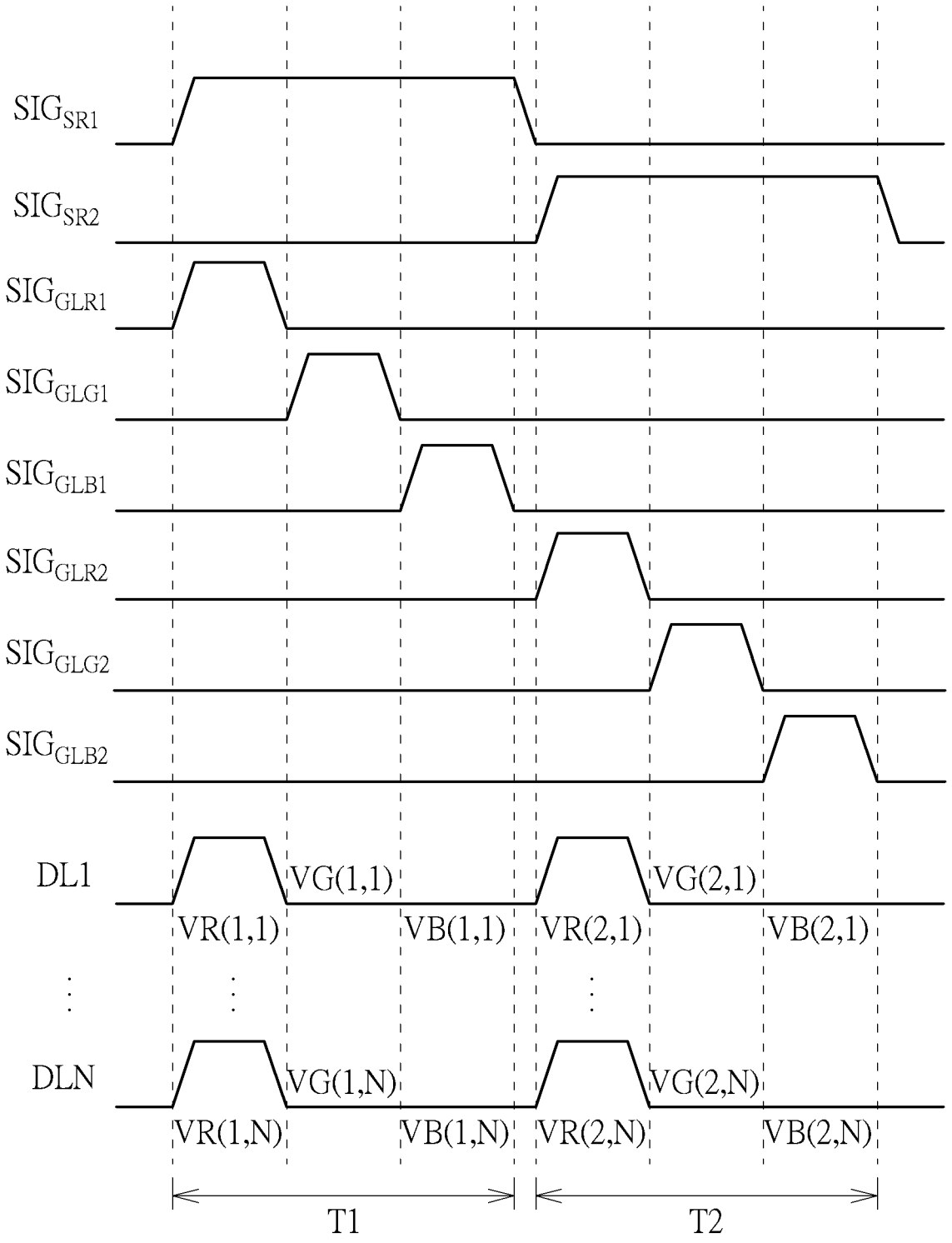
FIG. 3 shows parts of the timing diagram of the electronic device in FIG. 2.

FIG. 3 shows parts of the timing diagram of the electronic device 200. In FIG. 3, the first shift signal SIGSR1 and the second shift signal SIGSR2 generated by the first shift register 210A1 and the second shift register 210A2 will be raised to the high voltage level during the periods T1 and T2 successively. In period T1, the first gate driving signal SIGGLR1 can be raised to the high voltage level first so the first sub-pixels 230R(1,1) to 230R(1,N) can be driven to perform the scan operation. Meanwhile, the data lines DL1 to DLN will output the data voltages VR(1,1) to VR(1,N) to the first sub-pixels 230R(1,1) to 230R(1,N) correspondingly. Afterwards, the first gate driving signal SIGGLG1 will be raised to the high voltage level, and the first gate driving signal SIGGLR1 will be pulled back to the low voltage level. At this time, the first sub-pixels 230G(1,1) to 230G(1,N) can be driven to perform the scan operation, and the data lines DL1 to DLN will output the data voltages VG(1,1) to VG(1,N) to the first sub-pixels 230G(1,1) to 230G(1,N) correspondingly. Later, the first gate driving signal SIGGLB1 will be raised to the high voltage level, and the first gate driving signal SIGGLG1 will be pulled back to the low voltage level. At this time, the first sub-pixels 230B(1,1) to 230B(1,N) can be driven to perform the scan operation, and the data lines DL1 to DLN will output the data voltages VB(1,1) to VB(1,N) to the first sub-pixels 230B(1,1) to 230B(1,N) correspondingly.

Similarly, during the period T2, the second gate driving signals SIGGLR2, SIGGLG2, and SIGGLB2 will be raised to the high voltage level sequentially so the second sub-pixels 230R(2,1) to 230R(2,N), the second sub-pixels 230G(2,1) to 230G(2,N), and the second sub-pixels 230B(2,1) to 230B(2,N) will be driven to perform the scan operations sequentially, and the data lines DL1 to DLN will output the data voltages VR(2,1) to VR(2,N) to the second sub-pixels 230R(2,1) to 230R(2,N), output the data voltages VG(2,1) to VG(2,N) to the second sub-pixels 230G(2,1) to 230G(2,N), and output the data voltages VB(2,1) to VB(2,N) to the second sub-pixels 230B(2,1) to 230B(2,N) sequentially.

In the embodiment of the electronic device 200, since sub-pixels emitting light of different colors are arranged in different rows so sub-pixels of different colors can be driven to perform the scan operation in different periods, thereby allowing the data lines DL1 to DLN to transmit data voltages of different colors in different time periods. In the embodiment of the electronic device 100, since sub-pixels of different colors are driven at the same time, sub-pixels of different colors would not be able to share the same data lines. In this case, the data lines required by the electronic device 200 can be one third of the data lines required by the electronic device 100, and the electronic device 200 does not need the complicated data demultiplexer so the circuits and wires required by the electronic device 200 can be reduced. In FIG. 2, the inactive area 200B below the active area 200A can accommodate the fanout circuit 240 and the connection pads 250 (for coupling to the controller) without accommodating the data demultiplexer so the width of the inactive area 200B can be reduced. That is, the peripheral area of the electronic device 200 (for example, the width W2 of the bottom frame shown in FIG. 2) can be reduced.

In FIG. 2, the electronic device 200 can further include other shift registers 210A3 to 210AM, demultiplexers 220A3 to 220AM, and a plurality rows of sub-pixels 230R(3,1) to 230R(M,N), 230G(3,1) to 230G(M,N), and 230B(3,1) to 230B(M,N), where M is an integer greater than 1, and the operating principles aforementioned can still be applied. In addition, in FIG. 2, the shift registers 210A1 to 210AM can be disposed at two sides of the active area 200A so the uniformity of the brightness of the electronic device 200 can be improved. However, in some other embodiments, the electronic device 200 may have all the shift registers disposed at one side of the active area 200, for example, the left side or right side of the active area 200, according to the design requirement. Also, in some other embodiments, the electronic device 200 can have two shift registers on both sides of the active area 200A to drive the same gate line so the uniformity of the brightness can be further improved.

Figure 4:
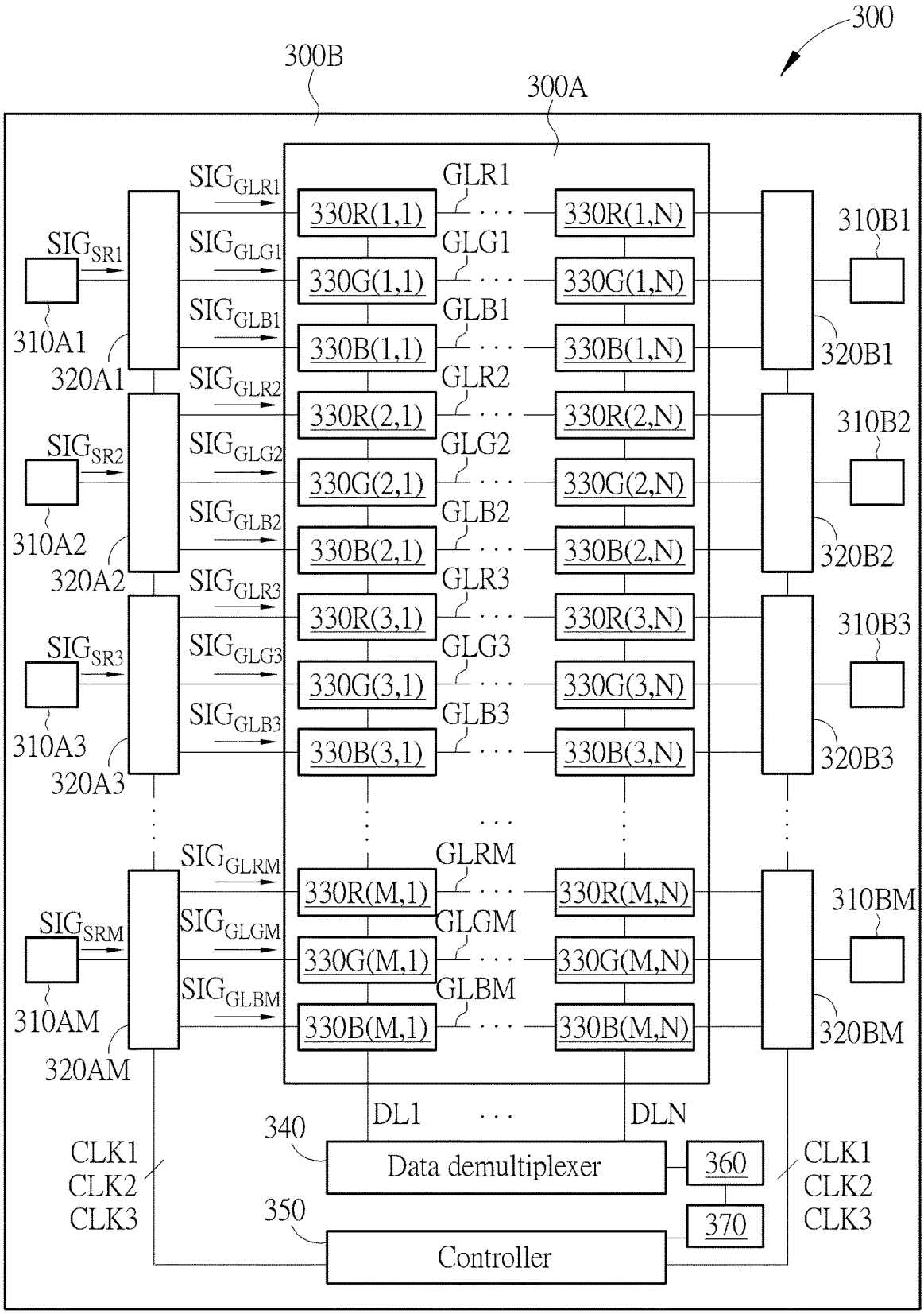
FIG. 4 shows an electronic device according to another embodiment of the present disclosure.

FIG. 4 shows an electronic device 300 according to one embodiment of the present disclosure. The electronic devices 200 and 300 have similar structures and can be operated with similar principles. However, the electronic device 300 can include shift registers 310A1 to 310AM and 310B1 to 310BM, demultiplexers 320A1 to 320AM and 320B1 to 320BM, gate lines GLR1 to GLRM, GLG1 to GLGM, and GLB1 to GLBM, and a plurality of sub-pixels 330R(1,1) to 330R(M,N), 330G(1,1) to 330G(M,N), and 330B(1,1) to 330B(M,N).

In FIG. 4, the shift registers 310A1 to 310AM and demultiplexers 320A1 to 320AM can be disposed at the left side of the active area 300A while the shift registers 310B1 to 310BM and demultiplexers 320B1 to 320BM can be disposed at the right side of the active area 300A. Therefore, both terminals of the gate lines GLR1 to GLRM, GLG1 to GLGM, and GLB1 to GLBM will receive the gate driving signals, reducing the issue of non-uniformity of the brightness caused by the sub-pixels 330R(1,1) to 330R(M,N), 330G(1,1) to 330G(M,N), and 330B(1,1) to 330B(M,N) receiving the gate driving signals of different intensities due to the different transmission distances.

In addition, in FIG. 4, the electronic device 300 can further include a data demultiplexer 340 and a controller 350 (the control IC), the controller 350 can be coupled to the fanout circuit 360 and the data demultiplexer 340 through the connection pads 370, and can be coupled to the demultiplexers 320A1 to 320AM and the demultiplexers 320B1 to 320BM through other wires. The data demultiplexer 340 can be coupled to the data lines DL1 to DLN and the controller 350. The controller 350 can control the data demultiplexer 340 to reduce the external wires required by the electronic device 300. Consequently, the area of the fanout circuit 360 and the area of the connection pads 370 can also be reduced, thereby further reducing the peripheral area of the electronic device 300 (for example, the width of the bottom frame).

Furthermore, in FIG. 4, the controller 350 can output a plurality of clock signals CLK1 to CLK3. In some embodiments, the demultiplexers 320A1 to 320AM and 320B1 to 320BM can generate the gate driving signals according to the signals outputted by the shift registers 310A1 to 310AM and 310B1 to 310BM and the clock signals CLK1 to CLK3.

Figure 5:
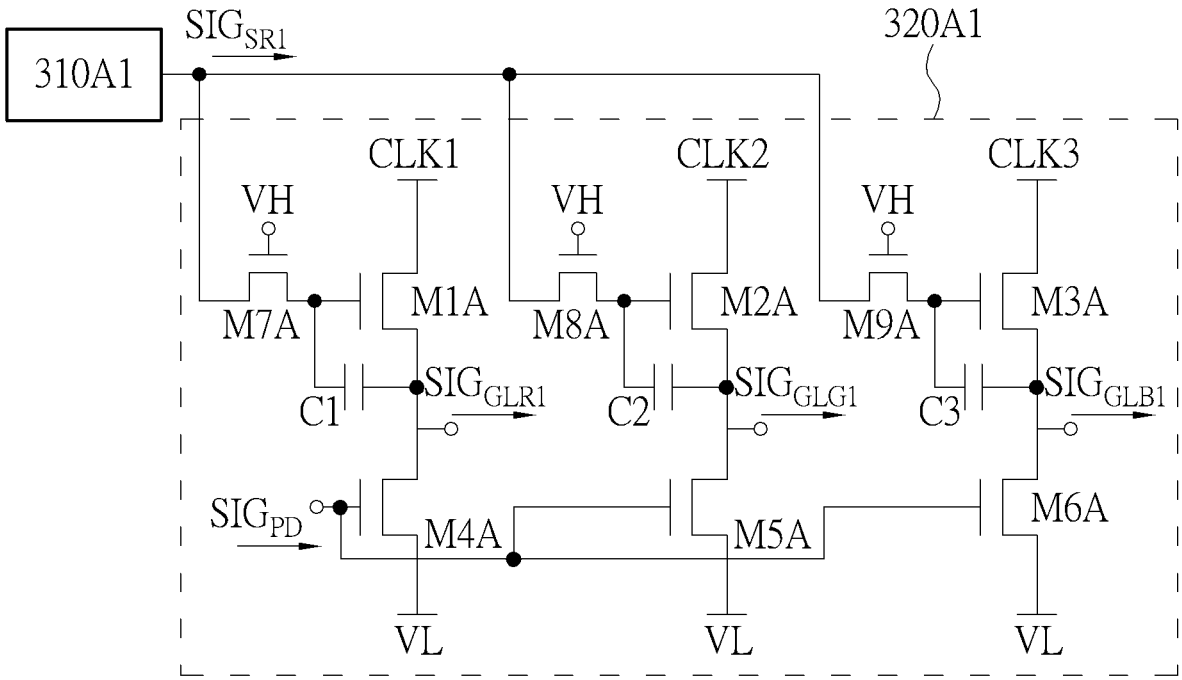
FIG. 5 shows a demultiplexer according to one embodiment of the present disclosure.

For example, the first demultiplexer 320A1 can output the first gate driving signal SIGGLR1, SIGGLG1, and SIGGLB1 according to the first shift signal SIGSR1 and the clock signals CLK1 to CLK3. FIG. 5 shows a demultiplexer 320A1 according to one embodiment of the present disclosure. The first demultiplexer 320A1 can include transistors M1A, M2A, and M3A. Each of the transistors M1A, M2A, and M3A has a first terminal for receiving a corresponding clock signal of the clock signals CLK1, CLK2 and CLK3, a second terminal for outputting a corresponding first gate driving signal of the first gate driving signal SIGGLR1, SIGGLG1, and SIGGLB1, and a control terminal coupled to the first shift register 310A1.

Figure 6:
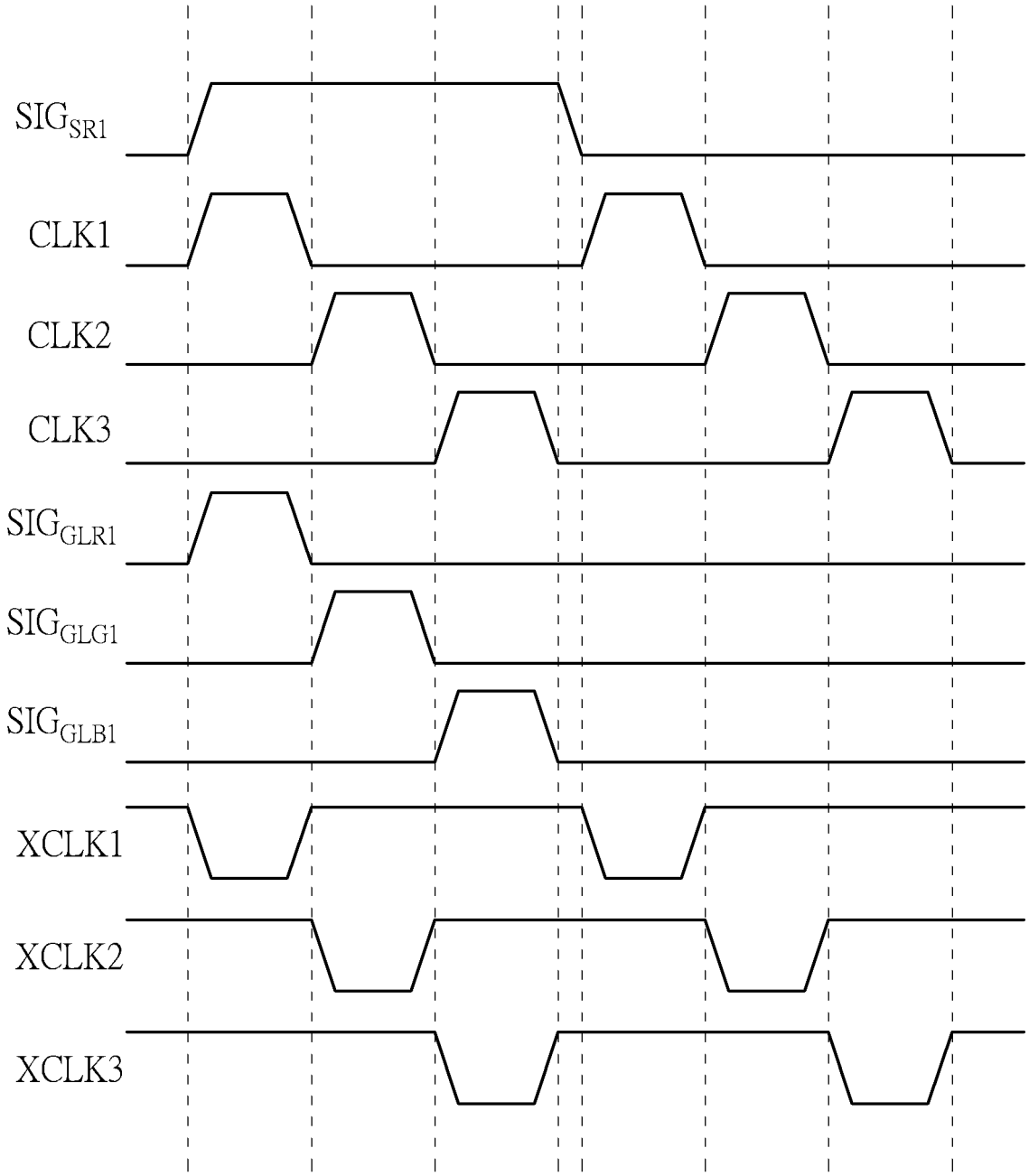
FIG. 6 shows a timing diagram of the first demultiplexer according to one embodiment of the present disclosure.

FIG. 6 shows a timing diagram of the first demultiplexer 320A1 according to one embodiment of the present disclosure. In FIG. 6, the clock signals CLK1, CLK2, and CLK3 will be raised to the high voltage level sequentially. Therefore, when the first shift signal SIGSR1 outputted by the first shift register 310A1 is at the high voltage level, the transistors M1A, M2A, and M3A will sequentially output the first gate driving signals SIGGLR1, SIGGLG1, and SIGGLB1 at the high voltage level.

Furthermore, in FIG. 5, the first demultiplexer 320A1 can further include transistors M4A, M5A, and M6A. Each of the transistors M4A, M5A, and M6A has a first terminal coupled to the second terminal of a corresponding transistor of the transistors M1A, M2A, and M3A, a second terminal for receiving the first system voltage VL, and a control terminal for receiving a pull-down control signal SIGPD. When the scan operation is not performed, the pull-down control signal SIGPD can turn on the transistors M4A, M5A, and M6A so the first gate driving signals SIGGLR1, SIGGLG1, and SIGGLB1 will be pulled down to the first system voltage VL, avoiding the sub-pixels from being driven unexpectedly.

In addition, since the transistors M1A to M3A can be N-type transistors, the first gate driving signals SIGGLR1, SIGGLG1, and SIGGLB1 may be affected by the threshold voltages of the transistors M1A to M3A when the transistors M1A to M3A are turned on. In this case, to ensure that the first gate driving signals SIGGLR1, SIGGLG1, and SIGGLB1 can reach the same high level as the clock signals CLK1, CLK2, and CLK3, the first demultiplexer 320A1 can further include transistors M7A, M8A, and M9A and capacitors C1, C2, and C3.

In FIG. 5, the control terminals of the transistors M1A, M2A, and M3A can be coupled to the first shift register 310A1 through the transistors M7A, M8A, and M9A respectively, and the control terminals of the transistors M7A, M8A, and M9A can receive the second system voltage VH. The second system voltage VH can be greater than the first system voltage VL and can turn on the transistors M7A, M8A, and M9A. Each of the capacitors C1, C2 and C3 can be coupled between the control terminal and the second terminal of the corresponding transistor of the transistors M1A, M2A, and M3A. By using the transistors M7A, M8A, and M9A and the capacitors C1, C2, and C3, the turn-on voltage received by the transistors M1A, M2A, and M3A can be raised, so the first gate driving signals SIGGLR1, SIGGLG1, SIGGLB1 can reach the high voltage level as the clock signals CLK1, CLK2, and CLK3.

Figure 7:
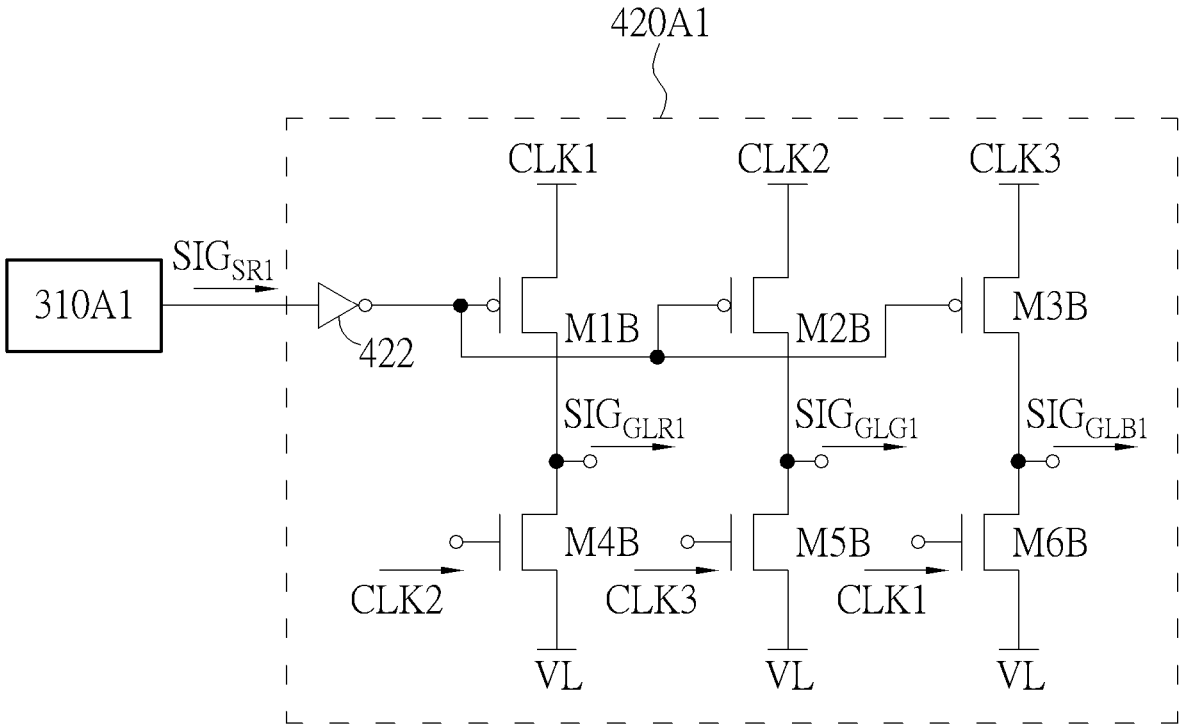
FIG. 7 shows a first demultiplexer according to another embodiment of the present disclosure.

In FIG. 5, transistors M1A to M9A can be N-type transistors so the manufacture process is rather simple. However, in some other embodiments, the demultiplexer can be implemented by P-type transistors. FIG. 7 shows a first demultiplexer 420A1 according to one embodiment of the present disclosure. In some embodiments, the first demultiplexer 420A1 can replace the first demultiplexer 220A1 in the electronic device 200 and the first demultiplexer 320A1 in the electronic device 300.

The first demultiplexer 420A1 can include the transistors M1B to M6B and the inverter 422. Each of the transistors M1B, M2B, and M3B has a first terminal for receiving a corresponding clock signal of the clock signals CLK1, CLK2, and CLK3, a second terminal for outputting a corresponding gate driving signal of the gate driving signals SIGGLR1, SIGGLG1, and SIGGLB1, and a control terminal coupled to the first shift register 310A1 through the inverter 422.

In some embodiments, the first demultiplexer 420A1 can have the same timing diagram as shown in FIG. 6. Since the inverter 422 can convert the high voltage level of the first shift register SIGSR1 to the low voltage level, the transistors M1B, M2B, and M3B will still be turned on to output the first gate driving signals SIGGLR1, SIGGLG1, and SIGGLB1 when the clock signals CLK1, CLK2, and CLK3 are raised to the high voltage level. In addition, since the transistors M1B to M3B are P-type transistors, which can be turned on by low voltages, the first gate driving signals SIGGLR1, SIGGLG1, and SIGGLB1 can reach the same high voltage level as the clock signals CLK1, CLK2, and CLK3 without being limited by the threshold voltages of the transistors M1B to M3B. Consequently, the capacitors adopted in FIG. 5 can be omitted, thereby reducing the area required by the first demultiplexer 420A1.

Furthermore, in FIG. 7, the control terminals of the transistors M4B, M5B, and M6B can receive the clock signals CLK2, CLK3, and CLK1 respectively, and the control terminals of the transistors M1B, M2B, and M3B can receive the inverted first shift signal SIGSR1 simultaneously. Therefore, the first gate driving signals SIGGLR1, SIGGLG1, and SIGGLB1 can be pulled down to the first system voltage VL by the transistors M4B, M5B, and M6B according to the clock signals CLK2, CLK3, and CLK1, improving the stability of the first demultiplexer 420A1. However, in some embodiments, the control terminals of the transistors M4B, M5B, and M6B can receive the same pull down control signals SIGPD as shown in FIG. 5.

Figure 8:
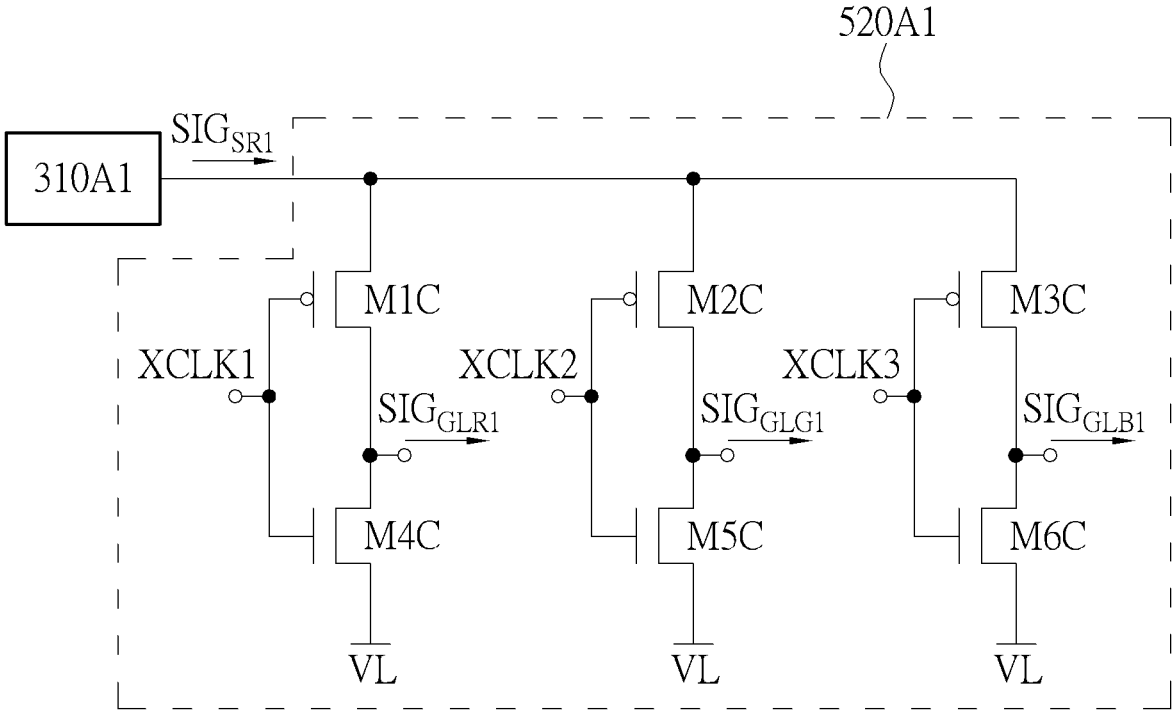
FIG. 8 shows a first demultiplexer according to another embodiment of the present disclosure.

FIG. 8 shows a first demultiplexer 520A1 according to one embodiment of the present disclosure. In some embodiments, the first demultiplexer 520A1 can replace the first demultiplexer 220A1 in the electronic device 200 and the first demultiplexer 320A1 in the electronic device 300.

The first demultiplexer 520A1 can include transistors M1C to M6C. Each of the transistors M1C, M2C, and M3C has a first terminal coupled to the first shift register 310A1 for receiving the first shift signal SIGSR1, a second terminal for outputting a corresponding first gate driving signal of the first gate driving signals SIGGLR1, SIGGLG1, and SIGGLB1, and a control terminal for receiving a corresponding clock signal of the clock signals XCLK1, XCLK2, and XCLK3.

Each of the transistors M4C, M5C, and M6C has a first terminal coupled to a second terminal of a corresponding transistor of the transistors M1C, M2C, and M3C, a second terminal for receiving the first system voltage VL, and a control terminal for receiving a corresponding clock signal of the clock signals XCLK1, XCLK2, and XCLK3.

In some other embodiments, the first demultiplexer 520A1 can have the same timing diagram as shown in FIG. 6. However, in FIGS. 5 and 7, the first demultiplexers 320A1 and 420A1 are operated with the clock signals CLK1, CLK2, and CLK3 while in FIG. 8, the first demultiplexer 520A1 can be operated with the clock signals XCLK1, XCLK2, and XCLK3. In this case, since the transistors M1C to M3C are P-type transistors, the first gate driving signals SIGGLR1, SIGGLG1, and SIGGLB1 can reach the same high voltage levels as the first shift signal SIGSR1.

In addition, since the transistors M4C, M5C, and M6C can be N-type transistors, and can pull down the first gate driving signals SIGGLR1, SIGGLG1, and SIGGLB1 to the first system voltage VL according to the clock signals XCLK1, XCLK2, and XCLK3, the stability of the first demultiplexer 520A1 can be improved.

In the electronic device 200, the first demultiplexer 220A1 can output the first gate driving signals SIGGLR1, SIGGLG1, and SIGGLB1 to the three rows of the sub-pixels 230R(1,1) to 230R(1,N), 230G(1,1) to 230G(1,N), and 230B(1,1) to 230B(1,N). However, in some other embodiments, the demultiplexers can be designed to output more first gate driving signals. For example, the SIGGLR1, SIGGLG1, SIGGLB1, SIGGLR2, SIGGLG2, and SIGGLB2 can be generated by one demultiplexer so that the number of shift registers required by the system can be reduced.

Furthermore, since the variation of the data voltages received by sub-pixels of different colors is rather large so it may cause more power consumption if the voltages on the data lines DL1 to DLN are switched continuously between data voltages of different colors. In some embodiments, the sequence of scan operation can be adjusted to reduce the switching frequency of the data voltages for different colors on the data lines DL1 to DLN so as to reduce the power consumption of the electronic device.

Figure 9:
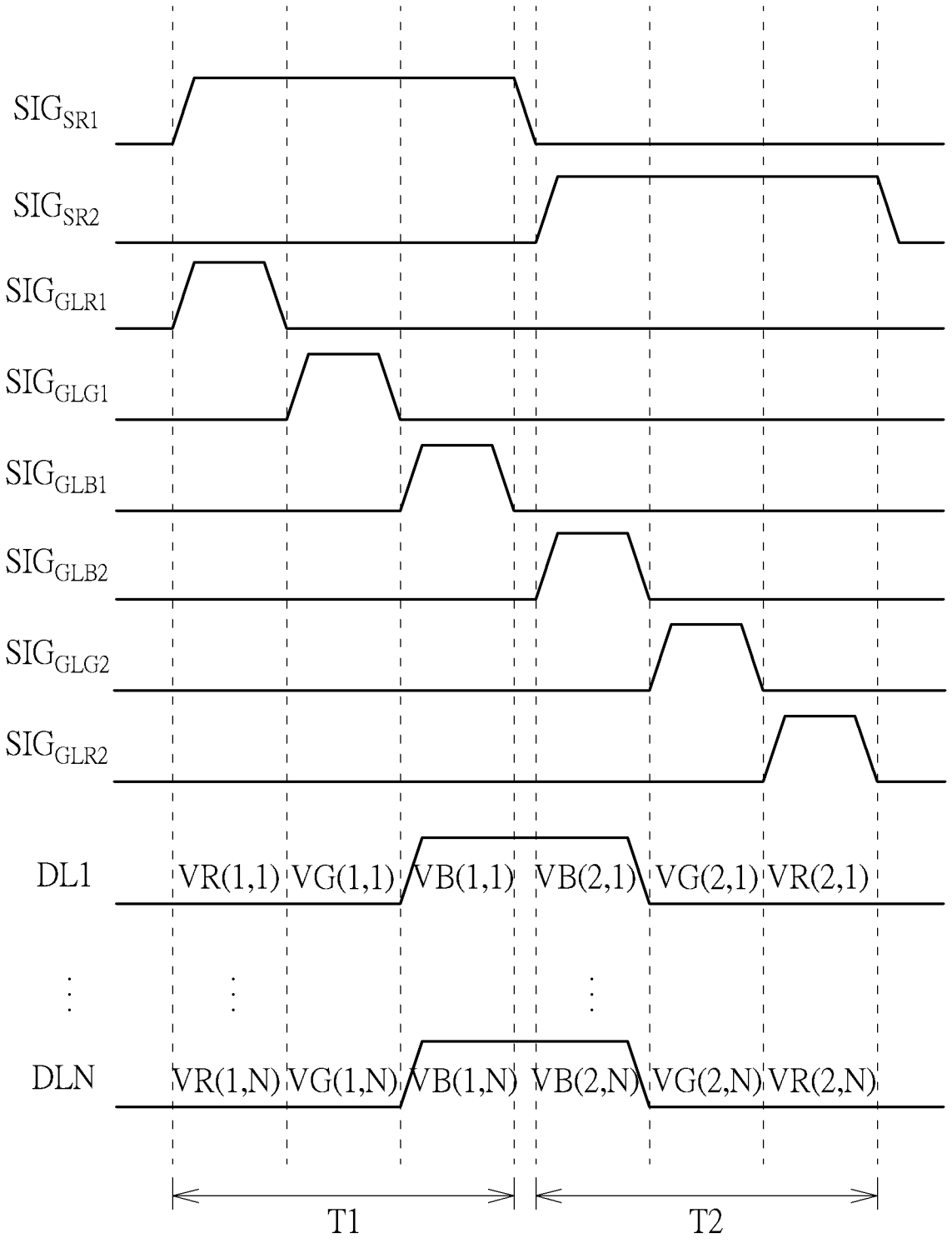
FIG. 9 shows part of the timing diagram of the electronic device in FIG. 2 according to one embodiment.

FIG. 9 shows part of the timing diagram of the electronic device 200 according to one embodiment. In FIG. 9, the first shift signal SIGSR1 and the second shift signal SIGSR2 generated by the first shift register 210A1 and the second shift register 210A2 can be raised to the high voltage levels in periods T1 and T2 respectively. In period T1, the first gate driving signals SIGGLR1, SIGGLG1 and SIGGLB1 will be raised to the high voltage levels sequentially, and thus, the data line DL1 to DLN will output the data voltages VR(1,1) to VR(1,N) corresponding to the first sub-pixels 230R(1,1) to 230R(1,N), the data voltages VG(1,1) to VG(1,N) corresponding to the first sub-pixels 230G(1,1) to 230G(1,N), and the data voltages VB(1,1) to VB(1,N) corresponding to the first sub-pixels 230B(1,1) to 230B(1,N) accordingly.

Furthermore, in period T2, the second gate driving signals SIGGLB2, SIGGLG2 and SIGGLR2 will be raised to the high voltage levels sequentially, and thus, the data line DL1 to DLN will output the data voltages VB(2,1) to VB(2,N) corresponding to the second sub-pixels 230B(2,1) to 230B(2,N), the data voltages VG(2,1) to VG(2,N) corresponding to the second sub-pixels 230G(2,1) to 230G(2,N), and the data voltages VR(2,1) to VR(2,N) corresponding to the second sub-pixels 230R(2,1) to 230R(2,N) accordingly.

That is, in FIG. 9, the first gate driving signal SIGGLB1 and the second gate driving signal SIGGLB2 will be outputted successively to the first sub-pixels 230B(1,1) to 230B(1,N) and the second sub-pixels 230B(2,1) to 230B(2,N) for emitting the blue light. Consequently, the data lines DL1 to DLN will transmit the data voltages for two rows of sub-pixels of the same color successively before switching to transmit the data voltage for sub-pixels of another color. Therefore, the power consumption caused by the high switching frequency of the data voltages on the data lines DL1 to DLN can be reduced.

In some embodiments, to further centralize the transmission periods of the data voltages for the same color, the demultiplexer can be coupled to the sub-pixels of the same color so that the sub-pixels of the same color but in different rows will perform the scan operation sequentially.

Figure 10:
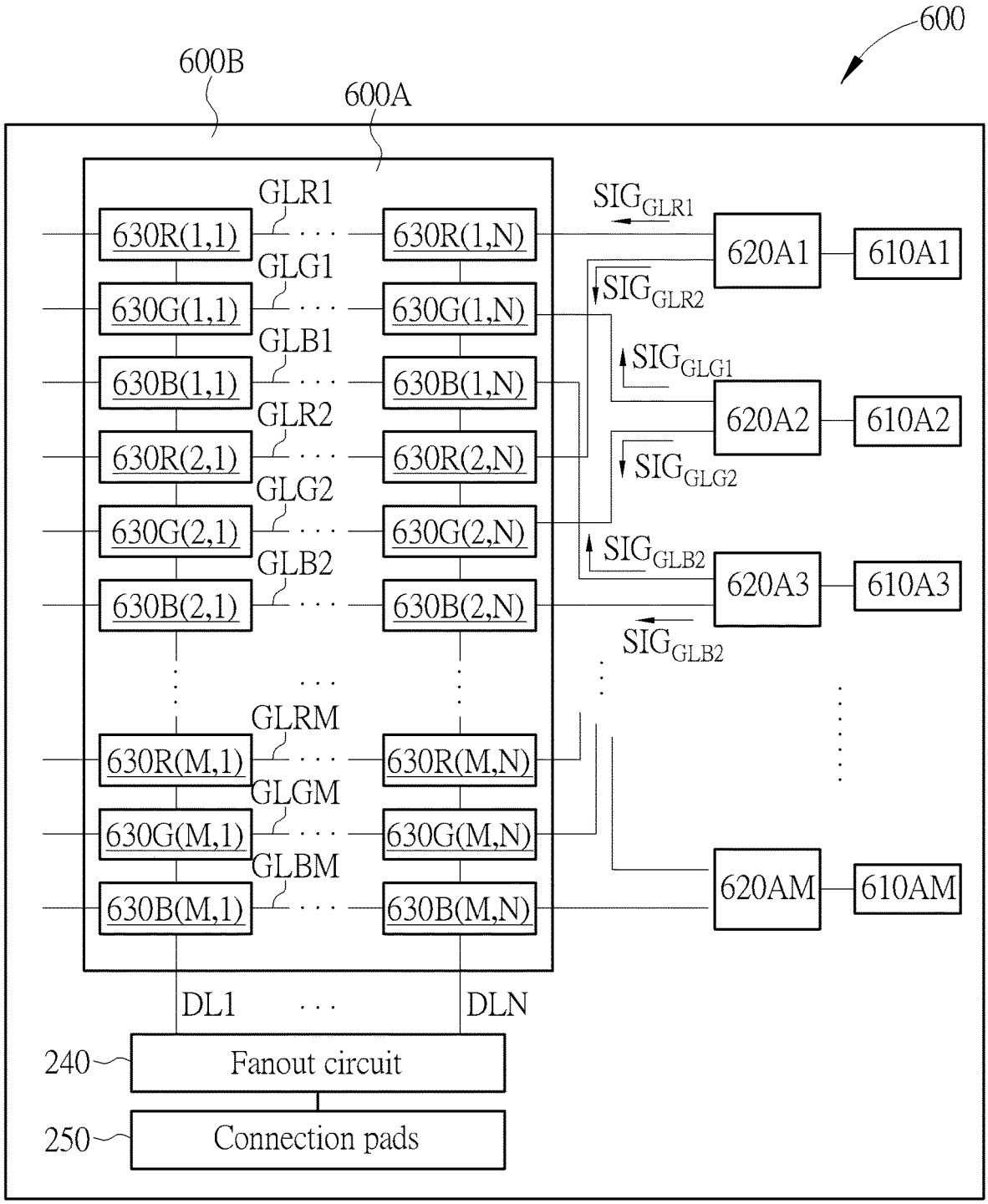
FIG. 10 shows an electronic device according to another embodiment of the present disclosure.

FIG. 10 shows an electronic device 600 according to one embodiment of the present disclosure. The electronic devices 200 and 600 have similar structures and can be operated with similar principles. However, the electronic device 600 can include the shift registers 610A1 to 610AM, demultiplexers 620A1 to 620AM, the gate lines GLR1 to GLRM, GLG1 to GLGM, and GLB1 to GLBM, and a plurality of rows of sub-pixels 630R(1,1) to 630R(M,N), 630G(1,1) to 630G(M,N), and 630B(1,1) to 630B(M,N).

Figure 11:
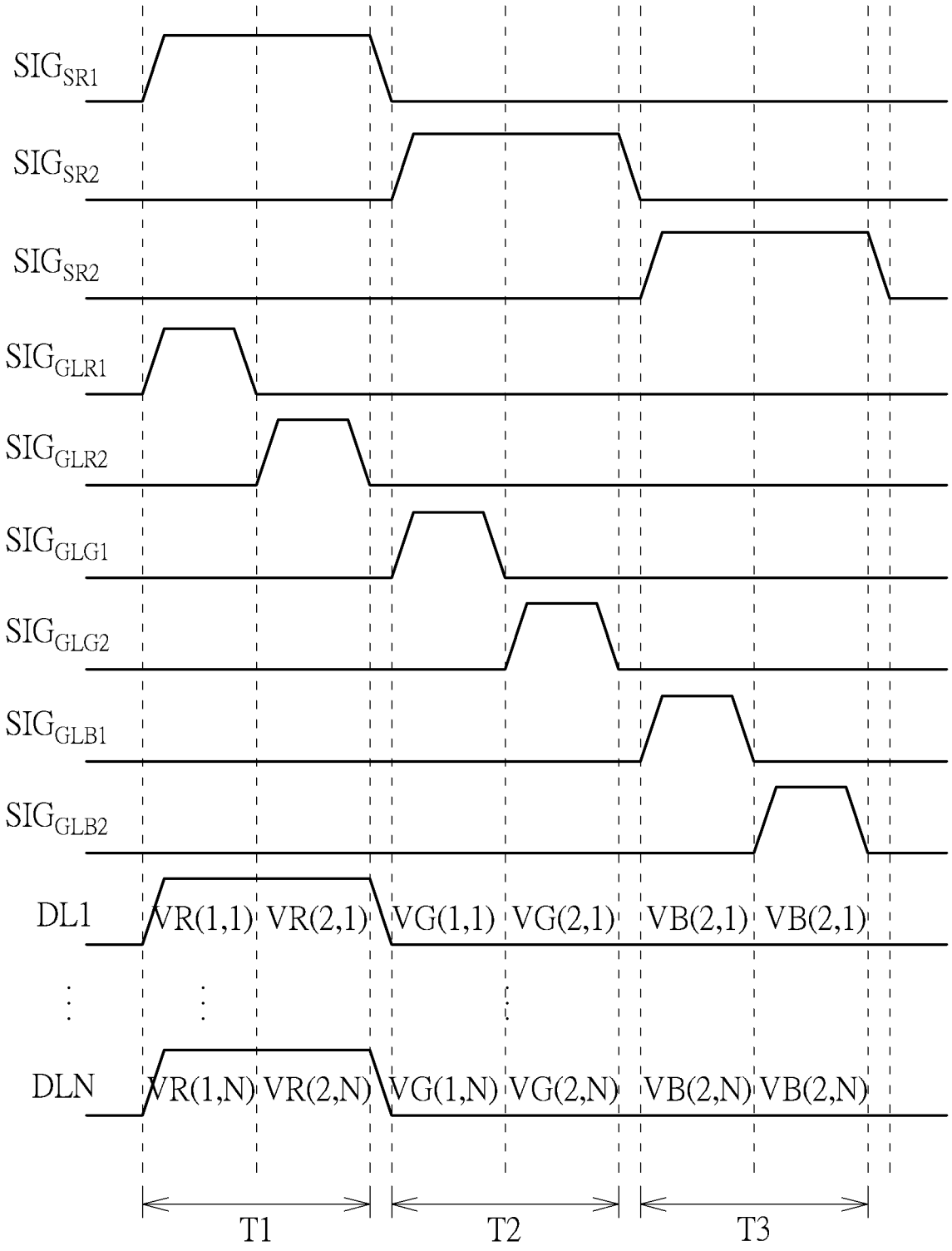
FIG. 11 shows a part of the timing diagram of the electronic device in FIG. 10.

In FIG. 10, the first demultiplexer 620A1 can be coupled to the first sub-pixels 630R(1,1) to 630R(1,N) and 630R(2,1) to 630R(2,N), the second demultiplexer 620A2 can be coupled to the second sub-pixels 630G(1,1) to 630G(1,N) and 630G(2,1) to 630G(2,N), and the third demultiplexer 620A3 can be coupled to the third sub-pixels 630B(1,1) to 630B(1,N) and 630B(2,1) to 630B(2,N). FIG. 11 shows a part of the timing diagram of the electronic device 600.

In FIG. 11, the first shift signal SIGSR1, the second shift signal SIGSR2, and the third shift signal SIGSR3 generated by the shift registers 610A1, 610A2, and 610A3 can be raised to the high voltage levels successively in periods T1, T2, and T3. In period T1, the first gate driving signals SIGGLR1 and SIGGLR2 can be raised to the high voltage levels successively, so the first sub-pixels 630R(1,1) to 630R(1,N) and 630R(2,1) to 630R(2,N) will be driven to perform the scan operations successively. Also, in this case, the data lines DL1 to DLN will transmit the data voltages VR(1,1) to VR(1,N) and VR(2,1) to VR(2,N) to the first sub-pixels 630R(1,1) to 630R(1,N) and 630R(2,1) to 630R(2,N). That is, the first gate driving signals SIGGLR1 and SIGGLR2 can be successively outputted to the first sub-pixels 630R(1,1) to 630R(1,N) and 630R(2,1) to 630R(2,N) to emit the red light.

Similarly, in period T2, the second gate driving signals SIGGLG1 and SIGGLG2 can be raised to the high voltage levels successively, and the data lines DL1 to DLN will transmit the data voltages VG(1,1) to VG(1,N) and VG(2,1) to VG(2,N) to the second sub-pixels 630G(1,1) to 630G(1,N) and 630G(2,1) to 630G(2,N). Also, in period T3, the third gate driving signals SIGGLB1 and SIGGLB2 can be raised to the high voltage levels successively, and the data lines DL1 to DLN will transmit the data voltages VB(1,1) to VB(1,N) and VB(2,1) to VB(2,N) to the third sub-pixels 630B(1,1) to 630B(1,N) and 630B(2,1) to 630B(2,N).

Consequently, the data lines DL1 to DLN can transmit the data voltages to two rows of sub-pixels of the same color successively, and can be switched to transmit the data voltages to another two rows of sub-pixels of the another color. Therefore, the power consumption caused by the high switching frequency of the data voltages for different colors on the data lines DL1 to DLN can be reduced.

Figure 12:
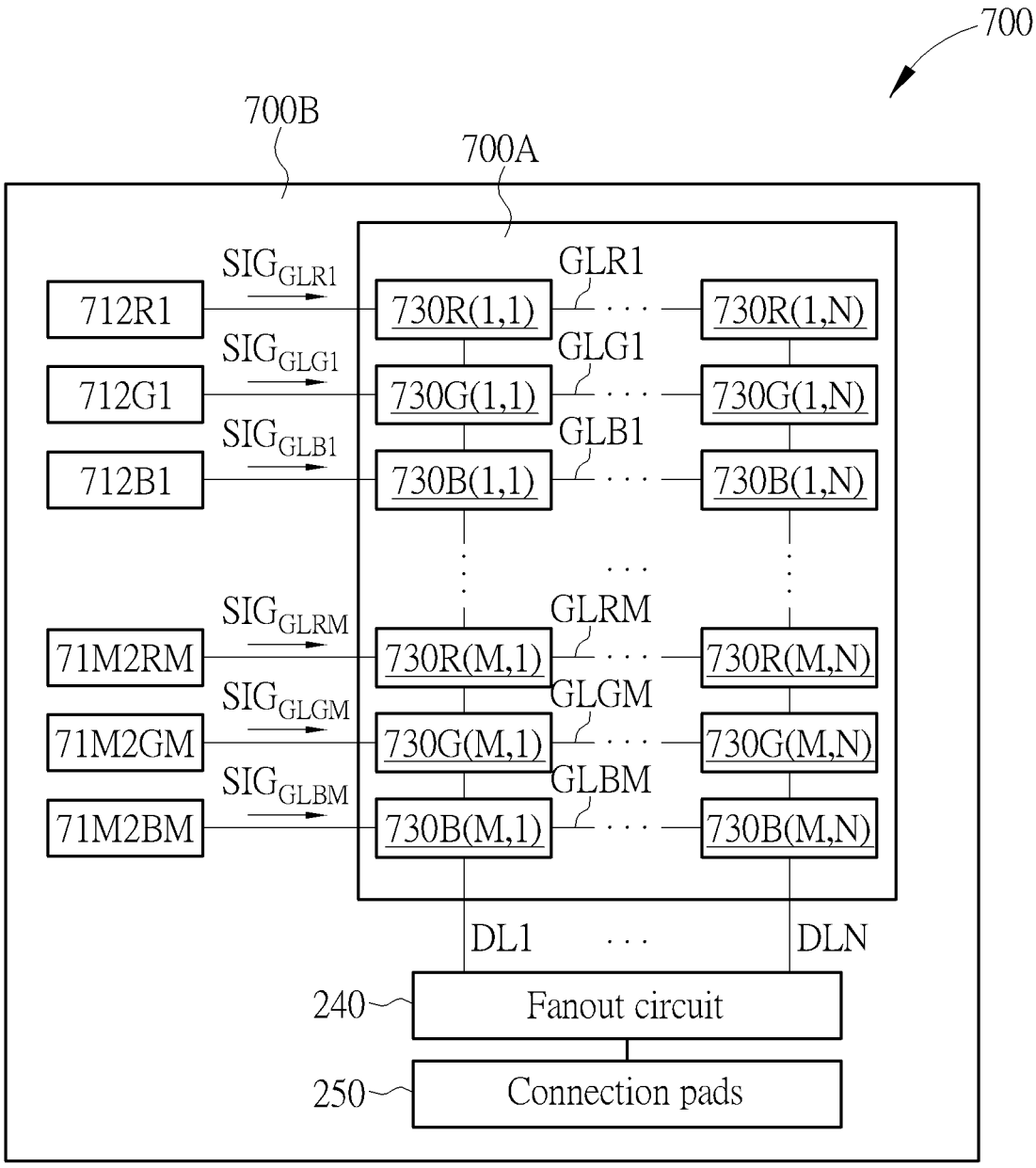
FIG. 12 shows an electronic device according to another embodiment of the present disclosure.

In the embodiments aforementioned, the electronic device can generate a plurality of gate driving signals with the demultiplexers. However, in some other embodiments, if the shift register can output signals strong enough to drive the gate lines, then the gate driving signals may also be generated by the shift registers without the demultiplexers. FIG. 12 shows an electronic device 700 according to one embodiment of the present disclosure.

In FIG. 12, the gate driving circuit 710 can include a plurality of shift registers 712R1 to 712RM, 712G1 to 712GM, and 712B1 to 712BM. Each of the shift registers 712R1 to 712RM, 712G1 to 712GM, and 712B1 to 712BM can output a corresponding gate driving signal of the gate driving signals SIGGLR1 to SIGGLRM, SIGGLG1 to SIGGLGM, and SIGGLB1 to SIGGLBM to the gate lines GLR1 to GLRM, GLG1 to GLGM and GLB1 to GLBM. Also, each row of the sub-pixels 730R(1,1) to 730R(M,N), 730G(1,1) to 730G(M,N), and 730B(1,1) to 730B(M,N), can be coupled to a corresponding gate line of the gate lines GLR1 to GLRM, GLG1 to GLGM and GLB1 to GLBM. In some embodiments, the electronic device 700 can be operated with the timing diagrams shown in FIGS. 3, 9, and 11.

In the electronic device 700, since the sub-pixels of different colors can be arranged along the vertical direction, the sub-pixels of different colors can be driven in different periods to perform the scan operations and the data lines DL1 to DLN can transmit the data voltages corresponding to different colors in different periods. In this case, the data lines DL1 to DLN required by the electronic device 200 can be one third of the data lines required by the electronic device 100. Furthermore, since the electronic device 700 can use the shift registers to generate the gate driving signals without using the demultiplexers, the hardware components required by the electronic device 700 can be reduced, reducing the peripheral area required by the electronic device 700. For example, the width of the bottom frame of the electronic device 700 can be reduced.

In summary, the electronic devices provided by the embodiments of the present disclosure can arrange the sub-pixels of different colors along the vertical direction so the sub-pixels of different colors can be driven by different gate lines. Therefore, the data line can transmit the data voltages corresponding to the same colors in successive periods for reducing the power consumption, and/or transmit the data voltages corresponding to different rows of sub-pixels in different periods to reduce the number of data lines. Furthermore, in some embodiments, since the electronic device can transmit the data voltages corresponding to different rows of sub-pixels in different periods, the data demultiplexers can be omitted, thereby reducing the hardware components required by the system and reducing the peripheral area of the electronic device. For example, the width of the bottom frame of the display panel can be reduced.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A display device comprising:

a first shift register configured to output a first shift signal;

a first demultiplexer coupled to the first shift register and configured to receive the first shift signal and output a plurality of first gate driving signals;

a controller configured to output a plurality of clock signals, wherein the first demultiplexer outputs the plurality of first gate driving signals according to the first shift signal and the plurality of clock signals, and wherein the first demultiplexer comprises a plurality of P-type transistors, each having a first terminal configured to receive a corresponding clock signal of the plurality of clock signals, a second terminal configured to output a corresponding first gate driving signal of the plurality of first gate driving signals, and a control terminal coupled to the first shift register, and the first demultiplexer comprises an inverter, and the control terminal of each P-type transistor is coupled to the first shift register through the inverter;

a plurality of first gate lines configured to receive the plurality of first gate driving signals; and a plurality of rows of first sub-pixels, each row of first sub-pixels being coupled to a corresponding first gate line of the plurality of first gate lines;

wherein first sub-pixels of a same row are configured to emit light of a same color.

2. The display device of claim 1, wherein the inverter is configured to convert a high voltage level of the first shift register to a low voltage level and the plurality of P-type transistors of the first demultiplexer are turned on to output the first gate driving signals when the clock signals are raised to a high voltage level.

3. A display device comprising:

a first shift register configured to output a first shift signal;

a first demultiplexer coupled to the first shift register and configured to receive the first shift signal and output a plurality of first gate driving signals;

a controller configured to output a plurality of clock signals, wherein the first demultiplexer outputs the plurality of first gate driving signals according to the first shift signal and the plurality of clock signals, and wherein the first demultiplexer comprises a plurality of transistors, each having a first terminal coupled to the first shift register for receiving the first shift signal, a second terminal configured to output a corresponding first gate driving signal of the plurality of first gate driving signals, and a control terminal configured to receive a corresponding clock signal of the plurality of clock signals;

a plurality of first gate lines configured to receive the plurality of first gate driving signals; and a plurality of rows of first sub-pixels, each row of first sub-pixels being coupled to a corresponding first gate line of the plurality of first gate lines;

wherein first sub-pixels of a same row are configured to emit light of a same color.

4. The display device of claim 3, wherein the plurality of transistors are p-type transistors.

5. An electronic device comprising:

a controller configured to output a plurality of clock signals;

a first demultiplexer configured to receive a first shift signal and output a plurality of first gate driving signals wherein the first demultiplexer outputs the plurality of first gate driving signals according to the first shift signal and the plurality of clock signals, and wherein the first demultiplexer comprises a plurality of transistors, each having a first terminal configured to receive the first shift signal, a second terminal configured to output a corresponding first gate driving signal of the plurality of first gate driving signals, and a control terminal configured to receive a corresponding clock signal of the plurality of clock signals;

a plurality of first gate lines coupled to the first demultiplexer and configured to receive the plurality of first gate driving signals; and a plurality of first sub-pixels, each coupled to a corresponding first gate line of the plurality of first gate lines;

wherein first sub-pixels corresponding to a same first gate line of the plurality of first gate lines are configured to emit light of a same color.

6. The electronic device of claim 5, wherein the plurality of transistors of the first demultiplexer are P-type transistors.

* * * * *